United States Patent [19]

Hirawata et al.

[11] Patent Number: 4,700,162

[45] Date of Patent: Oct. 13, 1987

[54] CONTACT MECHANISM OF ELECTRICAL CONTACT PIECES

[75] Inventors: Seiichi Hirawata, Fujisawa; Shigeru Kobayashi, Tokyo, both of Japan

[73] Assignee: Niles Parts Co., Ltd., Tokyo, Japan

[21] Appl. No.: 848,470

[22] Filed: Apr. 7, 1986

[51] Int. Cl.[4] ..... H01H 1/18

[52] U.S. Cl. ..... 335/196; 200/241; 335/200

[58] Field of Search ..... 200/237–242, 200/16 A, 271, 272; 335/196, 200, 197–199

[56] References Cited

U.S. PATENT DOCUMENTS

| | | | |
|---|---|---|---|
| 1,748,219 | 2/1930 | Hanel | 200/241 |
| 2,290,489 | 7/1942 | Nelsen et al. | 335/196 X |
| 2,292,497 | 8/1942 | Vradenburgh | 335/200 |
| 2,943,170 | 6/1960 | Vradenburgh | 335/200 |
| 3,731,240 | 5/1973 | Meyer | 335/200 X |
| 4,003,011 | 1/1977 | Hayden | 335/196 |

OTHER PUBLICATIONS

"How to Choose and Use Relays", published by Ohm Co., Ltd. (translation), Hans Saver et al., 8-31-76, pp. 15-36.

*Primary Examiner*—J. R. Scott

*Attorney, Agent, or Firm*—Vorys, Sater, Seymour & Pease

[57] ABSTRACT

In a contact mechanism having electrical contact pieces in a switching device integrated with a spring plate fixed at one end, a wiping movable contact piece is fixed to the other end of the spring plate and has a semispherical shape at the contact portion, and a fixed contact piece also has a semispherical shape at its contact with a movable contact piece. The level of the apex of the contact area of the movable contact piece is shifted toward the support point side of the movable contact piece from the level of the apex of the contact area of the fixed contact piece. Conversely, the level of the apex of the contact area of the fixed contact piece is shifted toward the lower base stand side from the level of the apex of the apex if the contact area of the movable contact piece. As a result, the movable contact piece can surely and easily contact and separate from the fixed contact piece, and the movement of the movable contact piece in sliding is improved.

11 Claims, 2 Drawing Figures

CONTACT MECHANISM OF ELECTRICAL CONTACT PIECES

BACKGROUND OF THE INVENTION

1. FILED OF THE INVENTION

The present invention relates to a contact mechanism having electrical contact pieces, such as a relay or switch. More particularly, this invention relates to a contact mechanism having electrical contact pieces which are so arranged that a movable contact piece can surely and easily contact and separate from a fixed contact piece, while maintaining a wiping effect. Still more particularly, this invention relates to a contact mechanism with a semispherically-shaped movable contact piece which wipes and slides on a semispherically-shaped fixed contact piece.

2. DESCRIPTION OF THE PRIOR ART

With regard to the contact pieces of a current relay or switch, generally the movable contact piece and the fixed contact piece are formed to be of semispherical and flat shapes respectively. With contact pieces having the structure described above, the contact piece is frequently welded to the contacted side by an arc. Also, it is often moved and a high electrical consumption results, so that an insulating film is easily generated on the contact piece. In this case, the contact resistance is increased, exerting an adverse effect on the function of the device. Further, the centers of the conventional fixed contact pieces and the movable contact piece are provided on the same line. Therefore, when a semispherically-shaped moving contact piece wipes and slides on a semispherically-shaped fixed contact piece, the problem occurs, in which the above-described moving contact slides beyond the fixed fixed contact piece and cannot be separated.

SUMMARY OF THE INVENTION

In the contact mechanism having the electrical contact pieces of the present invention, wherein the switching device is integrated with a spring plate fixed at one end, a movable wiping contact piece having a semispherically-shaped surface at its contact portion and a semispherically-shaped fixed contact piece which contacts the above-described moving contact piece, the apex of the contact area of the movable contact piece is laterally shifted from the apex of the contact area of the fixed contact piece toward the support point of the oscillating movable contact piece. In other words, by designing the contact areas of the movable and fixed contact pieces of the switch to have a semispherical shape, and by positioning the contact point of the moving contact piece at a location shifted toward the fixed side of the spring plate, the above-described problem is overcome.

An object of the present invention is, in a device which has a wiping contact point, to provide a contact mechanism of the electrical contact pieces wherein the movable contact piece surely and easily contacts and separates from the fixed contact piece.

Still another object of the present invention is to improve the wiping effect between the movable and fixed contact pieces.

Other objects and advantages of the present invention are apparent from the following written description of the invention taken with the accompanying explanation of the attached drawings.

BRIEF DESCRIPTION OF THE DRAWINGS

FIG. 1 and FIG. 2 are drawings showing one embodiment of the contact mechanism having the electrical contact pieces physically related according to the present invention, wherein:

FIG. 1 is a side view of a relay, adopting the contact mechanism with the electrical contact pieces, positioned according to the present invention; and FIG. 2 is an enlarged drawing of the portion designated by letter "A" as shown in FIG. 1.

DESCRIPTION OF THE PREFERRED EMBODIMENT

As an example of the embodiments of the contact mechanism of the electrical contact pieces, a relay is explained in detail using the attached drawings.

Figure 1:
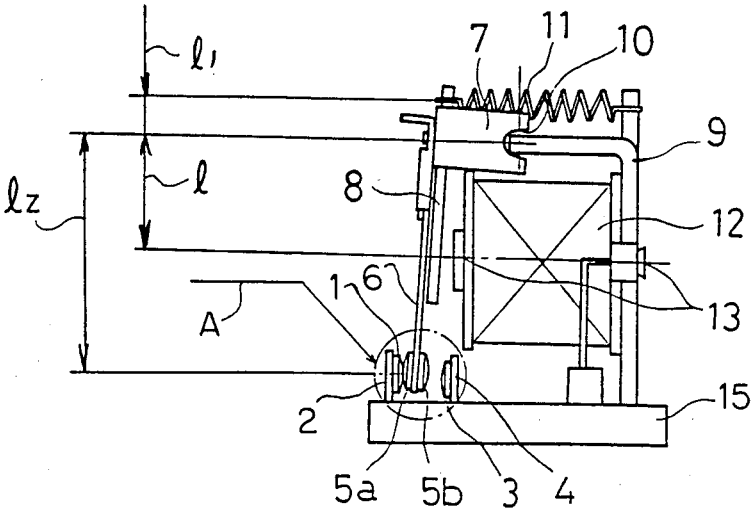
Figure 2:
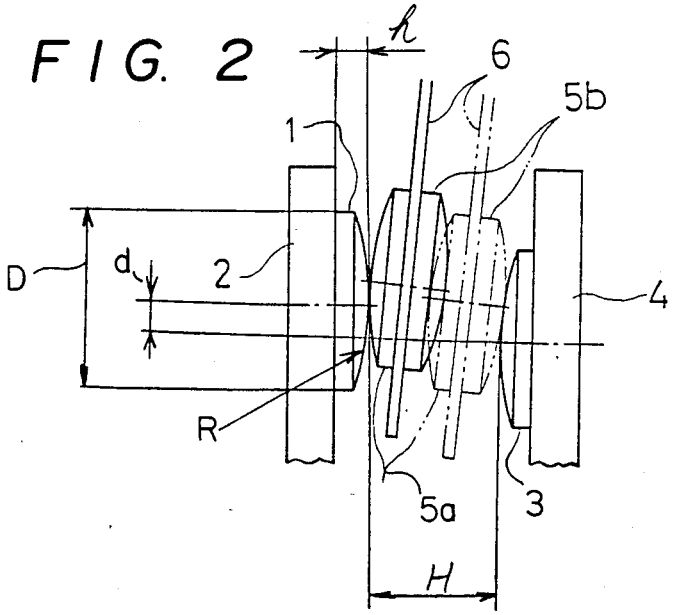

In FIGS. 1 and 2, a normally-closed (NC) fixed contact piece 1, having a contact area which contacts a movable contact piece 5*a*, is formed to have a semispherical shape, and is welded or fastened to a contact piece terminal 2. A normally-opened (NO) fixed contact piece 3, having a contact area which contacts a movable contact piece 5*b*, is formed to be semispherical, and is welded or fastened to a contact piece terminal 4. The movable contact pieces 5*a* and 5*b* are also respectively formed to be semispherical at their contact areas. The centers of the movable contact pieces 5*a* and 5*b* are located at a higher level than the center lines of the NC fixed contact piece 1 and the NO fixed contact piece 3. In other words, the movable pieces 5*a* and 5*b* are placed so that their respective center lines are intentionally shifted toward their support point side. Conversely, the positions of the NC fixed contact piece 1 and the NO fixed contact piece 3 are lower than the movable contact pieces 5*a* and 5*b* by inserting them into a lower position in a lower base stand 15.

The vertically shifted length should be longer than the lateral sliding length of the movable contact pieces 5*a* and 5*b* in the wiping period.

A spring plate 6 secures the movable contact pieces 5*a* and 5*b* at one end thereof. The other end is bent in an L-shape and is fastened to an armature 8 by rivets through a spacer 7. The spring plate 6, integrally fixed by rivets, and the armature 8 support the spacer 7 by a mechanism wherein a recessed portion 10 is the support point for the oscillating movable contact pieces 5*a* and 5*b*. The recessed portion 10 contacts a metal support member 9 and the armature is drawn by the elastic spring force of the spring 11. One end of the spring 11 is attached to the upper portion of the armature 8 and the other end is attached to the upper portion of the metal member 9 to pull the upper portion of the armature 8 toward the side of the metal member 9. A coil 12 is provided so that when electric current flows in the coil, a magnetic field is generated around its iron core 13 and the armature 8 is attracted, thus moving the contacts 5*a*, 5*b* from the position shown in FIG. 1. The coil 12 is fastened to the metal member 9 through the iron core 13.

The preferred example with regard to dimensional and positional relationships for each portion described above is discussed in the following. The distance l, lies from the reference position where the one end of the spring 11 is attached to the upper portion of the armature 8, to the center position of the recessed portion 10 of the spacer 7. The distance l lies from the center position of the recessed portion 10 of the spacer to the center position or axis of the iron core 13. The distance $l_2$ lies from the center position of the recessed portion 10 to the center position of the NC contact piece 1 of the contact piece terminal 2. By expressing those distances as described, the following relationships are established:

$$l \approx 3l;\ l_2 \approx 2l$$

That is, the distance from the center of the recess 10 to the axis of the core 13 is about three times the distance from the center of the recess 10 to the position where the spring 11 is connected to the armature 8, and about one-half the distance from the same location at the recess 10 to the center line of the contact piece terminal 2.

Furthermore, by expressing the radius R of the semispherical portion of the contact of each of the NC fixed contact piece 1, the NO fixed contact piece 3, and the movable contact pieces 5*a*, 5*b*, the diameter D of the NC fixed contact piece 1, the shifted length d of the center of the contact portion of the NC fixed contact piece 1 from the center of the contact portion of the NO fixed contact piece 3, the length H from the apex of the contact portion of the NC contact piece 1 to the apex of the contact piece of the NO fixed contact piece 3, and the distance h from the apex of the contact portion of the NC fixed contact piece 1 to the end of the movable contact piece side of the contact piece terminal 2, the following relationships are established:

$$R \approx 3 \cdot D;\ H \approx 4 \cdot h$$

In this case, the preferable values of d and D are as follows:

$$d = 0.1\text{–}1\ (\text{mm});\ D = \phi 3\ (\text{mm})\text{–}\phi 5\ (\text{mm})$$

The contact mechanism having the electrical contact pieces related according to the present invention is as described above, and its function discussed in the following.

The movable contact pieces 5*a* and 5*b*, attached to the free end of the spring plate 6, oscillate about the rotational support point where the recessed portion 10 of the spacer 7 fixed to the spring plate 6 with rivets contacts the metal member 9. When electrical current does not flow in the coil 12, the movable contact pieces 5*a* and 5*b*, as the upper portion of the armature 8 (which moves with the spring plate 6 being pulled by the spring 11 toward the side of the metal number 9) move clockwise and the movable contact piece 5*a*, located at the opposite side of the support point, contacts the NC fixed contact piece 1. The NC fixed contact piece 1 and the movable contact pieces 5*a*, 5*b* are each formed to have a spherical shape at its contact area as described above, in order to improve the endurability of the contact portion and to enhance the wiping effect. In this case, since the center of the wiping movable contact piece 5*a* is positioned at an upper level from the center of the NC contact piece 1 by a distance greater than the sliding length of the movable contact piece 5*a*, when the movable contact piece 5*a* wipes the NC fixed contact piece 1, the contact point of the semispherical movable contact piece 5*a* always is located at a higher position than the center of the NC fixed contact piece 1. Moreover, when it wipes, the contact point of the movable contact piece 5*a* does not move to a point beyond center; therefore, the movable contact piece 5*a* cannot be caught by the NC fixed contact piece 1.

When electric current flows in the coil 12, a magnetic field is generated around the iron core 13 and the iron core 13 attracts the armature 8. The movable contact piece 5*b*, which moves with the armature 8, oscillates and contacts the NO fixed contact piece 3 after slide wiping. In this case, since the center of the movable contact piece 5*b* with the semispherical contact portion is positioned at an upper level relative to the center of the contact portion of the NC fixed contact piece 3 by a distance more than sliding length of the movable contact piece 5*b*, when it wipes, the contact point of the movable contact piece 5*b* does not move to a point beyond the center at the apex of the contact area of the NO fixed contact piece 3; so, the movable contact piece 5*b* cannot be caught by the NC contact piece 3.

When the electric current to the coil 12 ceases, the movable contact pieces 5*a* and 5*b* move clockwise and the movable contact piece 5*a*, in the same way as described above, wipes and contacts the NC fixed contact piece 1.

The relay is explained in detail as one example of the contact mechanism of the electrical contact pieces related to the present invention; however, a switch which employs the slide wiping function can be explained in the same way.

The contact mechanism of the electrical contact piece related to the present invention has the integration and function described above, and has the following advantages.

Namely, the centers of the contact areas of the movable contact pieces 5*a* and 5 are shifted toward their support point, relative to the centers of the contact areas of the NC fixed contact piece 1 and the NO fixed contact piece 3 which contacts each of them, and are attached to the spring plate 6. Therefore, the wiping effect to the NC fixed contact piece 1 and the NO fixed contact piece 3 is effectively improved, and the behavior of the movable contact pieces 5*a* and 5*b* in sliding is also improved.

We claim:

1. A switching device comprising:

a first fixed contact piece, a semispherically-shaped first contact member secured to said first fixed contact piece and defining an apex about a centerline thereof, a movable contact piece, semispherically-shaped second and third contact members secured to said movable contact piece, and each defining an apex about a centerline thereof, a second fixed contact piece, a semispherically-shaped fourth contact member secured to said second fixed contact piece and defining an apex about a centerline thereof, a moving means for moving said movable contact piece between said first and second fixed contact pieces, said moving means including an armature which includes a spring plate to which said movable contact piece is secured, a biasing means for biasing said second contact member against said first contact member, and a coil with a core, said coil being positioned so that when energized and deenergized said movable contact piece reciprocates generally about a support location, and said third contact member is moved to contact said fourth contact member at a first contact location on said fourth contact member and to smoothly slide on said fourth contact member to a second contact location thereon, and a securing means for securing said first and second fixed contact pieces in spaced relation, and in position in relation to said movable contact piece such that said centerline of said first fixed contact piece is positioned displaced from said centerline of said movable contact piece away from said support location, and said second fixed contact piece is secured relative to said movable contact piece such that said first contact location is positioned a distance from said centerline of said second fixed contact piece towards said support location and second contact location is positioned on said fourth contact member at least as close to said support location as is said centerline of said second fixed contact piece.

2. The switching device of claim 1 wherein said centerlines of said first and second contact members are parallel.

3. The switching device of claim 2 wherein said centerlines of said first and second contact members lie in different horizontal planes.

4. The switching device of claim 2 wherein said centerlines of said first and second contact members lie in generally the same vertical plane.

5. The switching device of claim 2 wherein said centerline of said first contact member is positioned above said centerline of said second contact member.

6. The switching device of claim 1 wherein said securing means comprises a base member to which said first and second fixed contact pieces are secured.

7. The switching device of claim 6 wherein said base member is disposed parallel to the longitudinal axes of said core and of said biasing means.

8. The switching device of claim 6 further comprising a support member secured to said base member and said coil and core being attached to said support member and spaced from said base member.

9. The switching device of claim 1 further comprising a spacer secured to said spring plate, a support member to which said coil and core are secured, and said spacer defining a recess for pivoting relative to a portion of said support member.

10. The switching device of claim 9 wherein said recess defines said support location.

11. The switching device of claim 1 wherein said spring plate comprises a generally straight planar member between said armature and said second and third contact members.

* * * * *